US005809747A

United States Patent [19]

Spatafora

[11] Patent Number: 5,809,747

[45] Date of Patent: Sep. 22, 1998

[54] CONTINUOUS PRODUCT WRAPPING METHOD

[75] Inventor: Mario Spatafora, Bologna, Italy

[73] Assignee: Azionaria Construzioni Macchine Automatiche A.C.M.A. S.P.A., Bologna, Italy

[21] Appl. No.: 733,470

[22] Filed: Oct. 18, 1996

[30] Foreign Application Priority Data

Oct. 20, 1995 [IT] Italy ..... BO95A0500

[51] Int. Cl.[6] ..... B65B 11/34; B65B 11/54

[52] U.S. Cl. ..... 53/464; 53/227; 53/234

[58] Field of Search ..... 53/461, 464, 466, 53/234, 225, 227, 228, 232

[56] References Cited

U.S. PATENT DOCUMENTS

| | | | |
|---|---|---|---|
| 3,797,198 | 3/1974 | Fukuzaki | 53/227 X |
| 3,899,865 | 8/1975 | Revaz | 53/227 X |
| 4,358,920 | 11/1982 | Kanai | 53/516 |
| 5,490,368 | 2/1996 | Spatafora | 53/234 |

FOREIGN PATENT DOCUMENTS

| | | |
|---|---|---|
| 0553636 | 4/1993 | European Pat. Off. . |
| 247135 | 4/1926 | United Kingdom . |
| 1086180 | 10/1967 | United Kingdom . |

*Primary Examiner*—James F. Coan
*Attorney, Agent, or Firm*—Ladas & Parry

[57] ABSTRACT

A method of continuously wrapping products, whereby sheets of wrapping material, as they are fed continuously and together with respective products along a first path, an instantaneous tangent of which extends in a first direction possibly varying from one point to another along the first path, are engaged by respective folding tools fed continuously and cyclically along a second closed path to perform a folding operation of a respective sheet at each cycle; each tool being imparted, in the course of each folding operation, at least a first movement in a second direction substantially crosswise, at each instant, to the first direction, and at least a second movement in the first direction.

9 Claims, 8 Drawing Sheets

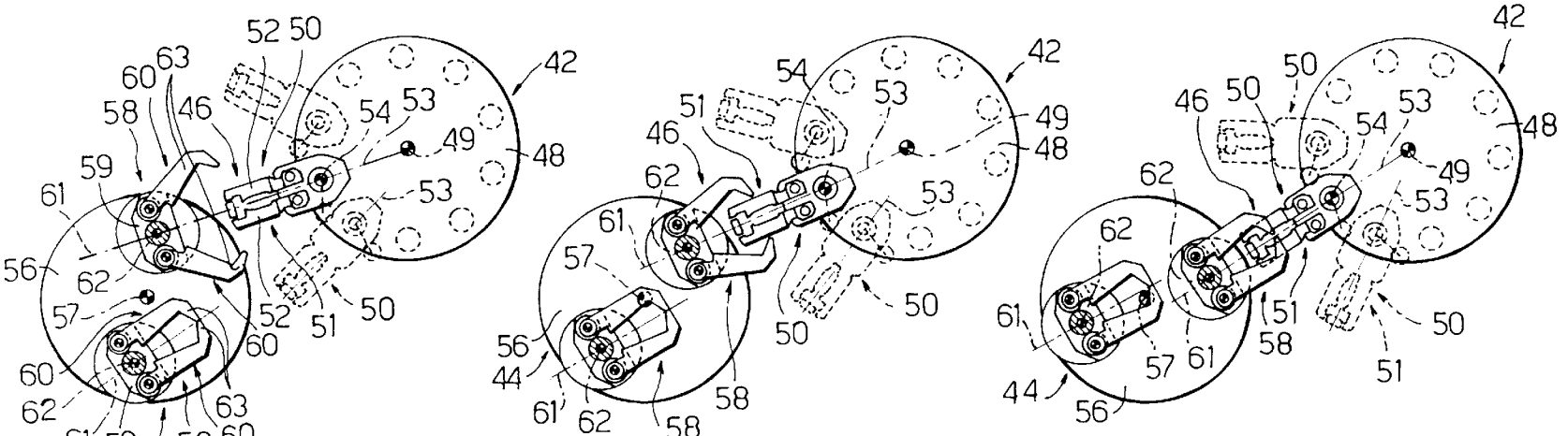
FIG. 3a
FIG. 3d
FIG. 3c
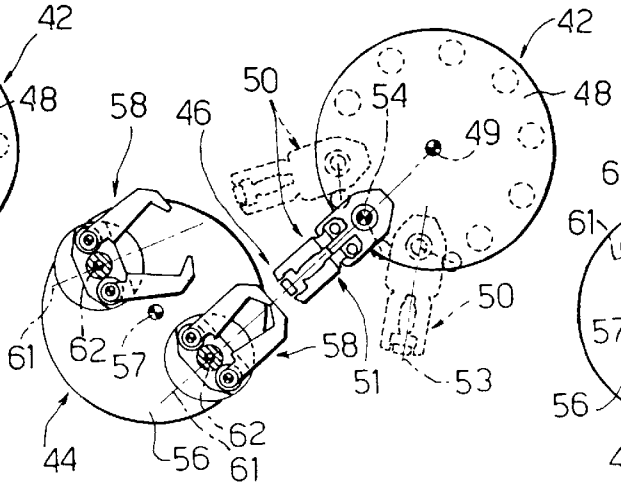
FIG. 3e
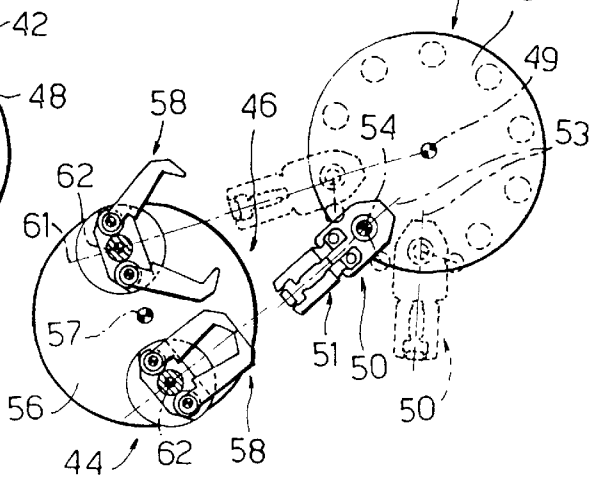
FIG. 3f
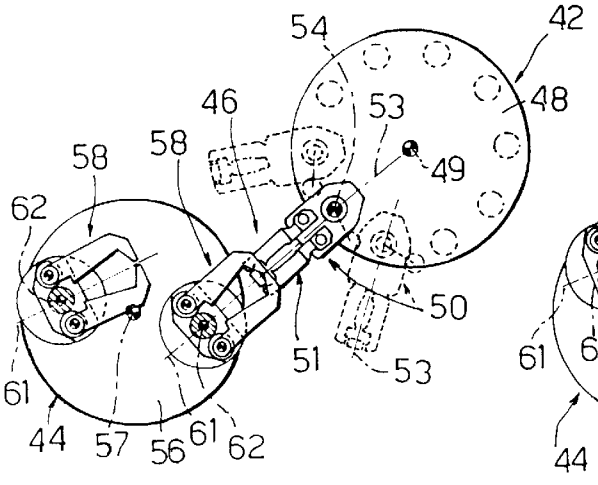
FIG. 3b

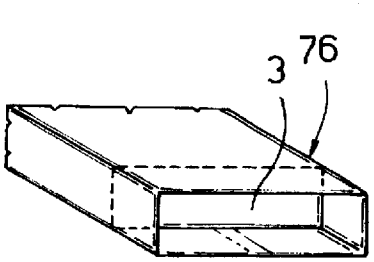
FIG. 4a
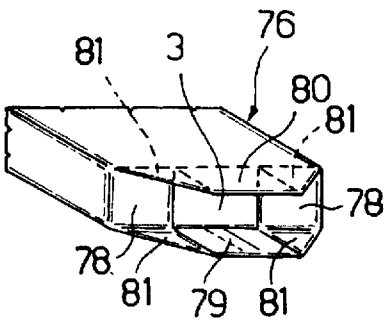
FIG. 4b
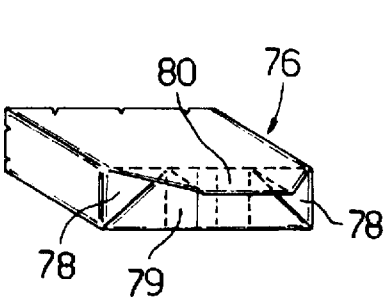
FIG. 4c
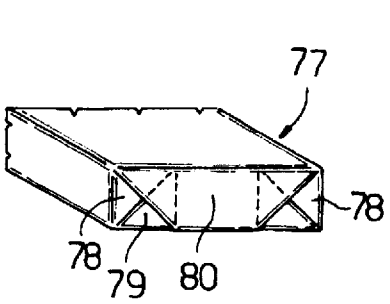
FIG. 4d
FIG. 6a
FIG. 6b
FIG. 6c
FIG. 6d

CONTINUOUS PRODUCT WRAPPING METHOD

BACKGROUND OF THE INVENTION

The present invention relates to a method of continuously wrapping products.

The present invention is particularly advantageous for wrapping food products, such as chocolates, chocolate bars and similar, to which the following description refers purely by way of example.

From U.S. Pat. No. 4,823,536, continuous wrapping machines are known to feed a succession of products along a given path by means of a conveyor, which, along a portion of the path, cooperates with a further conveyor presenting a succession of seats for receiving respective products. Each seat is so guided by the conveyor as to travel along said path portion together with and in a precise position in relation to the product, so that, despite keeping both conveyors moving, each seat may be arrested for a given length of time in relation to the respective product to enable the product to be inserted easily inside the seat. Before receiving the product, each seat is normally provided with a sheet of wrapping material, which is folded into a U about the product as this is inserted inside the seat.

As of this point, the folding operations to which each sheet is subjected to form a closed wrapping about the respective product are performed in various ways: using conveyors on which each seat presents one or more folding devices movable in relation to the seat; or using a cascade formation of conveyors for performing one or more folding operations as each product and respective sheet of wrapping material are transferred from one conveyor to another; or using a combination system wherein the folding operations are performed partly by folding devices carried on the conveyors, and partly by one or more transfers between cooperating conveyors.

The above methods present numerous economic and technical drawbacks. In particular, conveyors featuring movable folding devices for each product seat are extremely complicated in design and, hence, less reliable and considerably more expensive; whereas folding the sheet in the course of successive transfers from one conveyor to another involves the construction of relatively bulky, high-cost machines, the large number of component parts of which impair reliability and, above all, position control of the products as they are transferred from one conveyor to another.

SUMMARY OF THE INVENTION

It is an object of the present invention to provide a continuous product wrapping method designed to overcome the aforementioned drawbacks.

According to the present invention, there is provided a method of continuously wrapping products, the method comprising the steps of continuously feeding a succession of products, together with respective sheets of wrapping material at least partially folded about the respective products, along a first path, an instantaneous tangent of which extends in a first direction possibly varying from one point to another along the first path; continuously and cyclically feeding at least one folding tool along a second closed path; and causing said tool to cooperate at each cycle with the sheet of wrapping material of a said product to perform at least one folding operation of the sheet of wrapping material; the method being characterized in that the tool cooperates with the relative sheet of wrapping material as the sheet of wrapping material and the respective product travel continuously along an intermediate portion of the first path; said folding operation being performed, at least partly, by moving the tool in a second direction crosswise to said first direction, and by imparting to at least part of the tool a component of motion in said first direction.

According to the above method, each product and respective sheet of wrapping material are fed along the same path, and do not leave the path either before, during or after the folding operation performed by the relative folding tool; and a single folding tool, completely independent of the products, may be used cyclically to at least partially fold a sheet of wrapping material about a respective product at each cycle.

BRIEF DESCRIPTION OF THE DRAWINGS

A number of non-limiting embodiments of the present invention will be described by way of example with reference to the accompanying drawings, in which:

FIGS. 3(A) to 3(F) show the FIG. 2 detail at successive operating stages;

FIGS. 4(A) to 4(D) show views in perspective of successive stages in the folding of a second type of wrapping;

FIGS. 6(A) to 6(D) show views in perspective of successive stages in the folding of a third type of wrapping;

DETAILED DESCRIPTION OF THE INVENTION

Figure 1:
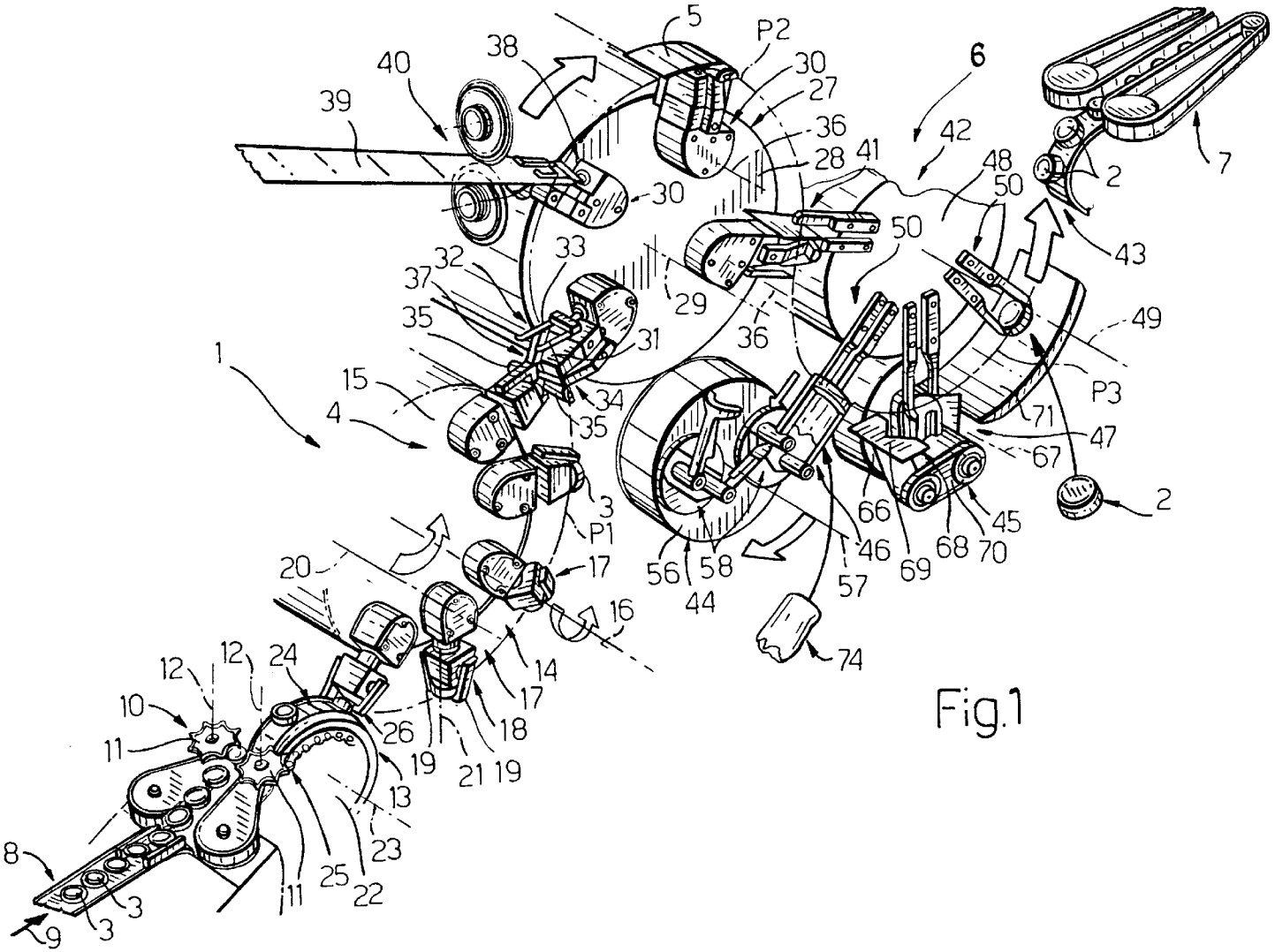
FIG. 1 shows a schematic view in perspective, with parts removed for clarity, of a wrapping machine implementing the method according to the present invention to form a first type of wrapping.

Number 1 in FIG. 1 indicates a wrapping machine for forming "bunch" wrappings 2 about products comprising, in the example shown, chocolates 3.

Machine 1 comprises an input portion 4 substantially of the type described in European Patent Applications n. 608, 823 and n. 608,824, and along which each chocolate 3 is paired with a respective sheet 5 of wrapping material; and an output portion 6 for receiving each chocolate 3, together with respective sheet 5 folded substantially in a U about chocolate 3, and for completing the folding of sheet 5 so as to supply an output conveyor 7 with an orderly succession of chocolates 3, each wrapped in a respective wrapping 2.

Portion 4 comprises an input conveyor 8 by which a substantially random succession of chocolates 3 is fed in a direction 9 to a known conveying and ordering device 10 comprising two opposed lobed wheels 11. Wheels 11 are of the type described in U.S. Pat. No. 5,301,792, and are mounted so as to rotate in opposite directions and in time with each other about respective axes 12 crosswise to direction 9, and transfer chocolates 3 at a given constant rate from conveyor 8 to a known accelerating and timing device 13 interposed between device 10 and a known gripper conveyor 14.

As shown in FIG. 1, conveyor 14 is of the type described in European Patent Application n. 608,823, and comprises a drum 15 rotating anticlockwise about an axis 16 crosswise to axes 12, and fitted with a number of peripheral gripper assemblies 17, each presenting a gripper head 18 comprising two opposed jaws 19. Each assembly 17 projects substantially radially outwards from drum 15, and, by means of a known cam actuating device (not shown), is oscillated in known manner and in relation to drum 15 about a respective axis 20 parallel to axis 16. Each head 18 is fitted to respective assembly 17 so as to rotate substantially 90°, in known manner in relation to drum 15 and about a respective substantially radial axis 21, between a gripping position in which respective jaws 19 lie in a plane parallel to axis 16, and a release position in which jaws 19 lie in a plane crosswise to axis 16.

Device 13 comprises a drum 22 of the type described in U.S. Pat. No. 5,318,165, and which is mounted to rotate, clockwise in FIG. 1, about an axis 23 parallel to axis 16, and at a surface speed greater than the surface speed of wheels 11. Drum 22 presents a cylindrical outer surface 24 substantially tangent to wheels 11 at a loading station 25, and extending through a transfer station 26 where drum 22 i tangent to a substantially circular path P1 travelled by jaws 19 of heads 18 as drum 15 rotates about axis 16. Surface 24 presents, in known manner, a number of through suction ports (not shown) equally spaced about axis 23, and which travel through station 25 at the same rate at which chocolates 3 are supplied by wheels 11, and which are each fed to station 26 in time with a respective head 18.

Input portion 4 of machine 1 also comprises a further gripper conveyor 27 of the type described in above European Patent Applications n. 608,823 and n. 608,824, and in turn comprising a drum 28 rotating clockwise about an axis 29 parallel to axis 16, and fitted with a number of peripheral gripper assemblies 30. Each assembly 30 comprises a central, substantially radial body 31, which defines a fixed jaw for a first gripper head 32 presenting a jaw 33 movable to and from body 31 in a plane crosswise to axis 29; each assembly 30 comprises a further gripper head 34 presenting two opposed jaws 35 fitted to body 31 and movable towards each other in a plane parallel to axis 29; each assembly 30 is fitted to drum 28 so as to oscillate, in known manner in relation to drum 28 and by means of a known cam actuating device (not shown), about a respective axis 36 parallel to axis 29; and jaws 35 travel, about axis 29, along a substantially circular path P2 tangent to path P1 at a transfer station 37. Downstream from station 37, path P2 extends through a loading station 38 where each head 32 receives a respective sheet 5 formed in known manner from a continuous strip 39 supplied in known manner (not shown) to station 38 in a substantially radial direction in relation to drum 28 and through a cutting device 40; and, downstream from station 38, path P2 extends through an input station 41 of output portion 6 of machine 1.

As stated, input portion 4 of machine 1 is known from European Patent Applications n. 608,823 and n. 608,824, to which reference is made for a more detailed description of the structure and operation of portion 4. Nevertheless, a brief description of the operation of portion 4 will now be given in the interest of full disclosure, and simply to enable a clear understanding of the description and operation of output portion 6 later on.

Chocolates 3, conveyed substantially randomly by conveyor 8, successively engage the movable seats defined by the opposed lobes of wheels 11 of conveying and ordering device 10, and are fed to station 25 at a constant rate equal to the rate of passage through station 25 of the suction ports (not shown) of drum 22, but not necessarily in time with the suction ports. That is, each chocolate 3 remains in station 25 and slides on surface 24 pending the arrival of one of said suction ports (not shown) by which it is transferred from station 25 to station 26 in time with head 18 of a gripper assembly 17.

Once gripped by jaws 19 of the relative head 18, each chocolate 3 is fed by drum 15 along path P1 from station 26 to station 37, and is simultaneously rotated 90° about relative axis 21 to enable jaws 35 of head 34 of relative gripper assembly 30, fed by drum 28 to station 37 in time with relative assembly 17, to grip chocolate 3 by the lateral surface portions left clear by jaws 19, and to position it outwards of the free end of relative fixed central body 31.

As drum 28 rotates, at a surface speed equal in absolute value to the surface speed of drum 15, each chocolate 3 is fed along path P2 through station 38 where the relative gripper head 32 receives, between body 31 and relative jaw 33, a leading portion of strip 39, which is cut by device 40 into a sheet 5. Once gripped by relative head 32, each sheet 5 is folded backwards, blown by the air and/or in contact with a fixed outer folding device (not shown), into an L about chocolate 3, and is fed in this position, together with chocolate 3, to station 41.

Figure 2:
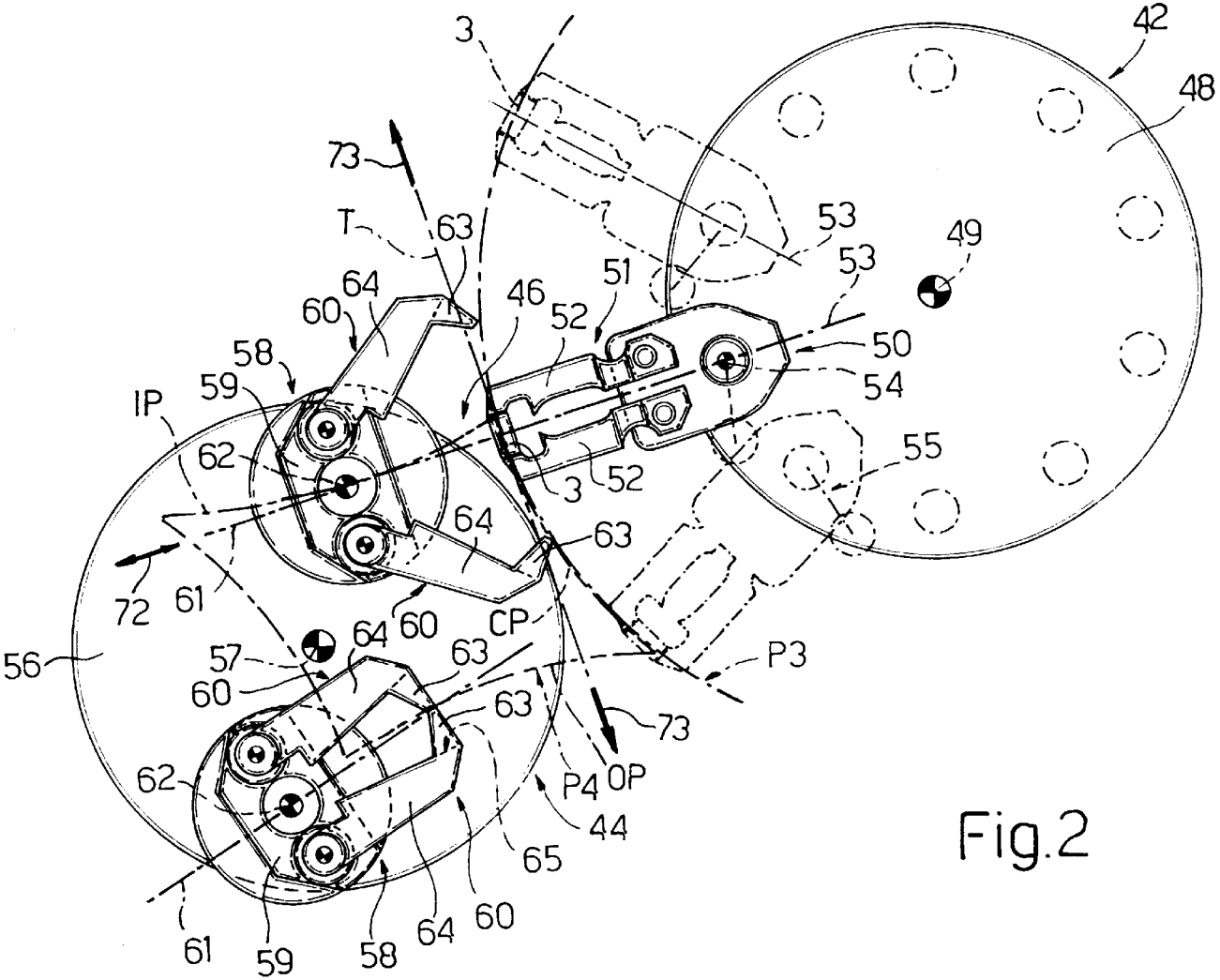
FIG. 2 shows a larger-scale schematic view of a detail in FIG. 1.

As shown schematically in FIG. 1 and in more detail in FIG. 2, output portion 6 of machine 1 comprises a further known gripper conveyor 42 for continuously feeding the groups comprising chocolates 3 and respective sheets 5 along a path P3 tangent to path P2 at station 41 and to conveyor 7 at an unloading station 43; and two folding devices 44 and 45 located at respective folding station 46 and 47 along path P3.

As shown in FIG. 2, conveyor 42 comprises a drum 48 rotating anticlockwise about an axis 49 parallel to axis 16, and fitted with a number of peripheral gripper assemblies 50, each presenting a gripper head 51 comprising two opposed jaws 52. Each assembly 50 projects outwards from drum 48 with jaws 52 positioned symmetrically in relation to a substantially radial axis 53, and is oscillated, in relation to drum 48 and about a respective axis 54 parallel to axis 49, by a known cam actuating device 55 shown only partially by the dotted line.

As shown in FIG. 2, folding device 44 comprises a drum 56 rotating clockwise about an axis 57 parallel to axis 49, and fitted with a given number (two in the example shown) of peripheral folding tools 58, each presenting a gripper type folding head 59 comprising two opposed folding elements 60 hereinafter referred to as jaws. Each tool 58 is located along the outer periphery of drum 56 with the two jaws 60 positioned symmetrically in relation to an axis 61 crosswise to axis 57, and rotates, in relation to drum 56, about a respective axis 62 parallel to axis 57 and perpendicular to axis 61. Each jaw 60 comprises a curved head 63; and an arm 64, which is hinged to relative head 59 so as to oscillate, about an axis parallel to respective axis 62, to and from a closed position in which respective head 63 cooperates with head 63 of the other jaw 60 to define a passage 65 coaxial with axis 61, and presenting a section approximately equal to but no smaller than that of a chocolate 3 crosswise to axis 53 of relative assembly 50, and presenting recesses for the passage of jaws 52.

From the foregoing description and FIG. 2, it therefore follows that each tool 58 moves cyclically and continuously along a closed path P4 coplanar with path P3 and presenting a portion substantially coincident with a central portion CP of path P3; and that each tool 58, as it travels along path P4, interferes with path P3 along a given arc hereinafter referred to as the "folding arc", and which comprises portion CP, a portion IP of path P4 converging towards portion CP and hence towards path P3, and a portion OP of path P4 diverging from portion CP and hence from path P3.

As also follows from FIG. 2, each tool 58 travels along path P4 in a movement comprising a combination of three distinct movements. In a first, tool 58 rotates continuously clockwise, in FIG. 2, about axis 57 together with drum 56, which rotation is so timed that each tool 58 travels along the folding arc in time with a relative head 51. In a second movement, tool 58 rotates continuously anticlockwise, in FIG. 2, about respective axis 62 and at an angular speed identical in absolute value to that of drum 56, so that the first and second movements combined cause tool 58 to translate about axis 57 (axis 61 is maintained parallel to itself). In a third movement, tool 58 oscillates about respective axis 62 to maintain axis 61 coaxial with axis 53 of relative head 51 substantially along the entire folding arc, and also to form in known manner a polygonal path P4 with outwardly-concave curved sides. By appropriately regulating the inclination of axis 53 at the input of the folding arc, portion CP of path P3 may, in known manner, be made to substantially coincide with a corresponding portion of path P4.

The reason the devices permitting the above three movements are not illustrated is to stress, if not already apparent, the importance of the sequence of operations performed by tools 58, as opposed to the mechanisms by which it is made possible. Any expert in the field would have absolutely no difficulty in selecting the appropriate mechanisms for performing said sequence, once this was made known.

Purely in the interest of full disclosure, suffice it to say that the first of said movements is achieved, obviously, by connecting drum 56 to a rotary shaft (not shown); the second may be achieved in known manner by connecting each tool 58 to a planetary gear (not shown) of an epicyclic gear train (not shown) of the type described, for example, in European Patent Application n. 599,162, and interposed between tools 58 and said rotary shaft (not shown); and the third may be achieved using helical teeth (not shown) for said epicyclic gear train (not shown), and by moving the planetary gears (not shown) axially back and forth, as described in the above European patent application.

As shown in FIG. 1, folding station 47 is located downstream from station 46 along path P3; and folding device 45 comprises a drum 66 rotating clockwise about an axis 67 parallel to axis 49, and fitted with a peripheral tool 68 presenting a jaw 69, which is moved cyclically, by an actuating belt device 70, to and from an operating position in which it cooperates with a fixed jaw 71 defined by a curved plate located along path P3, between stations 47 and 43, and tangent to a surface of chocolates 3 facing radially outwards in relation to drum 48.

In actual use, and with reference to FIG. 1, each chocolate 3 reaches station 41 with respective sheet 5 gripped by jaw 33 against body 31 of gripper head 32, and folded in an L about chocolate 3; and, at station 41, chocolate 3 gradually engages the gap between jaws 52 of gripper head 51 of a respective assembly 50, which folds sheet 5 in a U about chocolate 3 before gripping and feeding chocolate 3, together with sheet 5, to folding station 46, which extends over the whole of the folding arc.

With reference to FIGS. 3A to 3F, each assembly 50 reaches the start of the folding arc (FIG. 3A) in time with a respective tool 58, and both assembly 50 and tool 58 have by this time been rotated about respective axes 54 and 62 so that respective axes 53 and 61 are coaxial. Due to the smaller diameter of drum 56 as compared with drum 48, the coaxial position of axes 53 and 61 is maintained as assembly 50 and tool 58 travel along the whole of the folding arc, in particular by rotating head 59 about respective axis 62, and by maintaining respective head 51 in a substantially constant radial position.

Once positioned with axis 61 coaxial with axis 53 of respective head 51 at the start of portion IP of path P4, each tool 58 effects a relative approach movement, in relation to head 51, by moving along portion IP along instantaneous axis 53-61 in a direction 72 (FIG. 2) substantially perpendicular, at each instant, to the instantaneous tangent T (FIG. 2) of path P3, so as to shorten the distance between its own axis 62 and axis 54 of respective head 51. This first relative approach movement of tool 58 is effected with jaws 60 in the parted position to enable respective head 51 to be inserted between jaws 60 (FIGS. 3A and 3B). On reaching the start of portion CP, along which axes 54 and 62 are maintained at a minimum distance from each other (FIG. 3C), tool 58 effects a second approach movement, by moving heads 63 of respective jaws 60 towards each other and substantially in a second direction 73 (FIG. 2) parallel to the instantaneous tangent T of path P3 (FIG. 2) and coplanar with direction 72 and paths P3 and P4, so as to close heads 63 on to jaws 52 in the space between axis 54 and group 3-5 gripped between jaws 52 and comprising a chocolate 3 and a respective sheet 5 folded in a U about chocolate 3.

At this point, as drums 48 and 56 rotate further, tool 58 begins travelling along portion OP, and effects a relative work movement in direction 72 (FIGS. 3D, 3E, 3F) by which group 3-5 is "extruded" through passage 65 (FIG. 2) to fold sheet 5 into an intermediate cup-shaped wrapping 74 (FIG. 1), the bottom portion of which houses chocolate 3.

As shown in FIG. 1, intermediate wrapping 74 and respective chocolate 3 are then fed by conveyor 42 to station 45 in time with a jaw 69, which is fed along a given portion of path P3 together with and immediately behind intermediate wrapping 74; actuating device 70 is operated to move jaw 69 forward in relation to drum 66, and so fold part of intermediate wrapping 74 beneath chocolate 3; the remaining part of intermediate wrapping 74 is folded beneath chocolate 3 on contacting fixed jaw 71, which completes the formation of wrapping 2; and wrapping 2 is transferred by conveyor 42 to station 43 and to output conveyor 7.

In the embodiment of FIGS. 5A to 5E, tools 58 are replaced by corresponding tools 75, each of which is fitted to drum 56 FIG. 2, (not shown in FIGS. 5A to 5E) in place of a corresponding tool 58, to close the end of a tubular wrapping 76 formed, along path P3, by engaging a U-folded sheet 5 by means of a movable and a fixed tool (not shown) similar to jaws 69 and 71.

Each tool 75 is normally associated with a second tool 75 (not shown) for closing the other end of tubular wrapping 76, and provides for forming a "point fold" wrapping 77 (FIGS. 4A to 4D), in which each end of tubular wrapping 76 projecting beyond the corresponding end of chocolate 3 is folded to define two small, substantially rectangular tabs 78 directly contacting chocolate 3, a large trapezoidal inner tab 79, and a large trapezoidal outer tab 80; each tab 79, 80 presenting inner lateral reinforcing tabs 81 connecting it to tabs 78.

Each tool 75 rotates with drum 56, and oscillates, in relation to drum 56, about a respective axis 62 FIG. 2, (not shown in FIGS. 5A to 5E) in substantially the same way as tool 58. As shown in FIGS. 5A to 5E, each tool 75 comprises a central, substantially rectangular folding element 82 designed to oscillate as described above about respective axis 62 (not shown) and presenting a longer longitudinal axis coincident with a respective axis 61; and two gripper type folding heads 83 and 84 comprising respective pairs of jaws 85 and 86 defining two folding elements. Each tool 75 is located along the outer periphery of drum 56 with each pair of jaws 85, 86 positioned symmetrically in relation to axis 61; each jaw 85, 86 is substantially L-shaped, and comprises an arm 87, 88 hinged to and oscillating in relation to folding element 82 about an axis parallel to axis 57 (FIG. 2), and a folding element 89, 90 crosswise to respective arm 87, 88; and each folding element 89, 90 extends towards the other folding element 89, 90, and is movable into an operating position outwards of the free end of folding element 82.

Figures 5A, 5B, 5C, 5D, 5E:
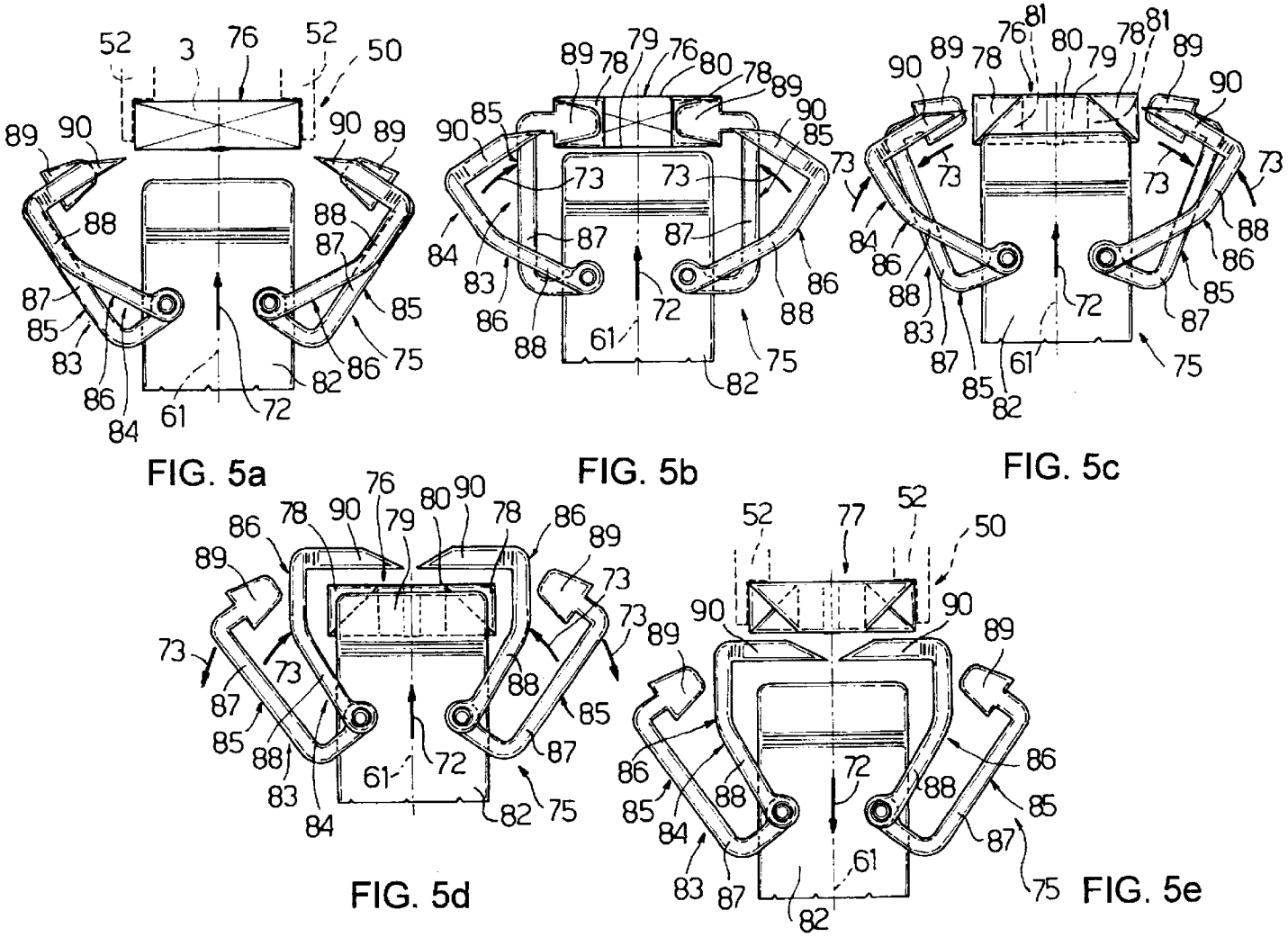
FIGS. 5(A) to 5(E) show schematic views of a first variation of a FIG. 2 detail at successive operating stages in the formation of the FIG. 4(A) to FIG. 4(D) wrapping.
Figures 7A, 7B, 7C, 7D, 7E:
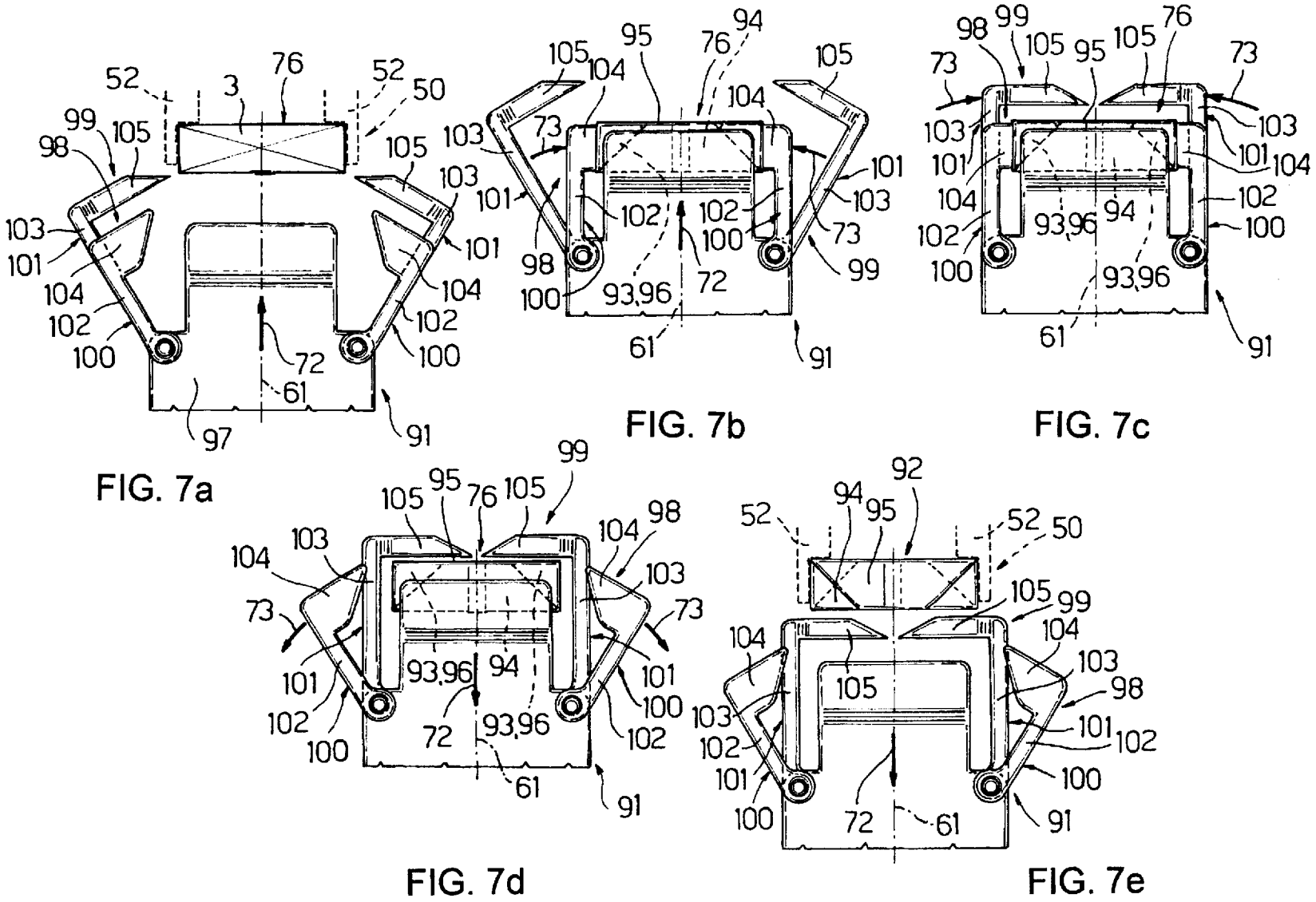
FIGS. 7(A) to 7(E) show views of a second variation of a FIG. 2 detail at successive operating stages in the formation of the FIGS. 6(A) to 6(D) wrapping.

In actual use, and as shown in FIGS. 5A to 5E and already stated in connection with the shape of path P4, tool 75, as it travels along portion IP of path P4, effects a first approach movement to move folding element 82 and heads 83, 84 along axis 53-61 in direction 72 (FIG. 5A) so that folding elements 89 of head 83 are positioned substantially tangent to path P3 and on either side of tubular wrapping 76 (FIG. 5B). At this point, jaws 85 of head 83 effect a rapid reciprocating work swing, and respective folding elements 89 effect a rapid reciprocating movement in direction 73 (FIGS. 5B, 5C) to fold small tabs 78 down on to the end of chocolate 3.

At the same time, folding element 82 continues moving in direction 72 to fold tab 79 (FIGS. 5C, 5D) completely on to tabs 78, and position folding elements 90 beyond wrapping 76 to enable head 84 to be closed (FIG. 5D) without interfering with wrapping 76 as tool 75 travels along portion CP.

As tool 75 starts travelling along portion OP, the movement of folding element 82 in direction 72 is inverted (FIG. 5E) to enable folding element 82 to release tab 79, and to enable folding elements 90 of head 84, still in the closed position, to engage and fold tab 80 on to tab 79, thus completing wrapping 77.

In the embodiment of FIGS. 7A to 7E, tools 75 in FIGS. 5A to 5E are replaced by corresponding tools 91, each of which is fitted to drum 56 in place of a corresponding tool 75, to close the end of a tubular wrapping 76 formed, along path P3, by engaging a U-folded sheet 5 by means of a movable and a fixed tool (not shown) similar to jaws 69 and 71.

Each tool 91 is normally associated with a second tool 91 (not shown) for closing the other end of tubular wrapping 76, and provides for forming a wrapping 92 (FIGS. 6A to 6D), in which each end of tubular wrapping 76 projecting beyond the corresponding end of chocolate 3 is folded to define two small, substantially triangular tabs 93 directly contacting chocolate 3, a large substantially rectangular inner tab 94, and a large trapezoidal outer tab 95; each tab 94, 95 presenting inner lateral reinforcing tabs 96 connecting it to tabs 93.

Each tool 91 rotates with drum 56, and oscillates, in relation to drum 56, about a respective axis 62 FIG. 2 (not shown in FIGS. 7A to 7E) in substantially the same way as tool 75. As shown in FIGS. 7A to 7E, each tool 91 comprises a central, substantially rectangular folding element 97 designed to oscillate as described above about respective axis 62 (not shown) and presenting a longer longitudinal axis coincident with a respective axis 61; and two gripper type folding heads 98 and 99 comprising respective pairs of jaws 100 and 101 defining two folding elements. Each tool 91 is located along the outer periphery of drum 56 with each pair of jaws 100, 101 positioned symmetrically in relation to axis 61; each jaw 100, 101 is substantially L-shaped, and comprises an arm 102, 103 hinged to and oscillating in relation to folding element 97 about an axis parallel to axis 57 (FIG. 2), and a folding element 104, 105 crosswise to respective arm 102, 103; each folding element 104 extends towards the other folding element 104, and is movable into an operating position in which folding element 104 is positioned over an end portion of folding element 97; and each folding element 105 extends towards the other folding element 105, and is movable into an operating position outwards of the free end of folding element 97.

In actual use, and as shown in FIGS. 7A to 7E and already stated in connection with the shape of path P4 in FIG. 2, tool 91, as it travels along portion IP, effects a first approach movement to move folding element 97 and heads 98, 99 along axis 53-61 in direction 72 (FIG. 7A) so that folding element 97 engages tab 94 of tubular wrapping 76 and continues moving in direction 72 so that tab 94 is completely folded by the start of portion CP. At the same time tool 91 is travelling along portion IP (FIG. 7B), and before folding element 97 begins folding tab 94, folding elements 104 are moved towards each other in direction 73 to fold tabs 93 on to chocolate 3 and reinforcing tabs 96 of tab 94 on to respective tabs 93, and to define the reinforcing tabs 96 of outer tab 95. As tool 91 travels along portion CP, folding elements 105 are moved towards each other in direction 73 so as to close (FIG. 7C) outwards of tab 95; before tool 91 leaves portion CP, folding elements 104 are parted in direction 73 (FIG. 7D) to release wrapping 76; and, as tool 91 starts travelling along portion OP (FIG. 7E), the movement of folding element 97 in direction 72 is inverted to enable folding elements 105 to engage and fold tab 95 on to tab 94, thus completing wrapping 92.

In the FIGS. 9A to 9E and 10A to 10C embodiment, tools 75 in FIGS. 5A to 5E are replaced by corresponding tools 196, each of which is fitted to drum 56 in place of a corresponding tool 75, to close the end of a tubular wrapping 76 formed, along path P3, by engaging a U-folded sheet 5 by means of a movable and a fixed tool (not shown) similar to jaws 69 and 71.

Each tool 106 is normally associated with a second tool 106 (not shown) for closing the other end of tubular wrapping 76, and provides for forming a "portfolio" wrapping 107 (FIGS. 8A to 8E), in which each end of tubular wrapping 76 projecting beyond the corresponding end of chocolate 3 is folded to define a large substantially rectangular inner tab 108 directly contacting the outer surface of chocolate 3, two small substantially triangular tabs 109 contacting the outer surface of tab 108, and a large trapezoidal outer tab 110. Tab 110 presents two lateral reinforcing tabs 111 connecting it to tabs 109, and is folded on to a respective lateral wall of wrapping 76.

Each tool 106 rotates with drum 56, and oscillates, in relation to drum 56, about a respective axis 62 (not shown in FIGS. 9A to 9E and 10A to 10C) in substantially the same way as tool 75. As shown in FIGS. 9A to 9E and 10A to 10C, each tool 106 comprises a gripper type folding head 112 in turn comprising two folding elements comprising two opposed jaws 113 fitted to a central support 114 connected to drum 56 so as to oscillate about axis 62. Jaws 113 are positioned symmetrically in relation to axis 61, and each comprise an end portion 115, one end of which forms the connecting rod of an articulated parallelogram 116 connecting end portion 115 to support 114.

Each end portion 115 comprises a folding arm 117 extending parallel to axis 61, connected at one end to the cranks of respective parallelogram 116, and connected at the other end to an appendix 118 crosswise to and facing axis 61, and coaxial with appendix 118 of the other jaw 113. Each end portion 115 also comprises a further folding arm 119 shorter than and extending parallel to arm 117 from the free end of appendix 118 towards support 114.

In actual use, and as shown in FIGS. 9A to 9E and 10A to 10C, tool 106, as it travels along portion IP of path P4 with jaws 113 open, effects a first approach movement to move head 112 along axis 61 in direction 72 (FIGS. 9A, 9B) so that arms 119 are positioned beyond and arms 117 on either side of wrapping 76. As tool 106 travels along portion CP, jaws 113 are closed partially to bring end portions 115 towards each other in direction 73 so that arms 117 (FIG. 9C) substantially contact wrapping 76, and the free ends of arms 119 are positioned facing tab 108 of wrapping 76.

As tool 106 begins travelling along portion OP of path P4, the movement of head 112 in direction 72 is inverted so that (FIGS. 9D, 9E) the free ends of arms 119 contact the inner surface of tab 110, thus engaging and folding tab 108 on to the respective end of chocolate 3. At the same time (FIG. 9E), jaws 113 are opened partially so that the surface of each arm 119 facing respective arm 117 contacts the inner surface of respective tab 109 to fold tab 109 about itself into a triangular shape.

Figures 8, 8A, 8B, 8C, 8D, 8E, 10A, 10B, 10C:
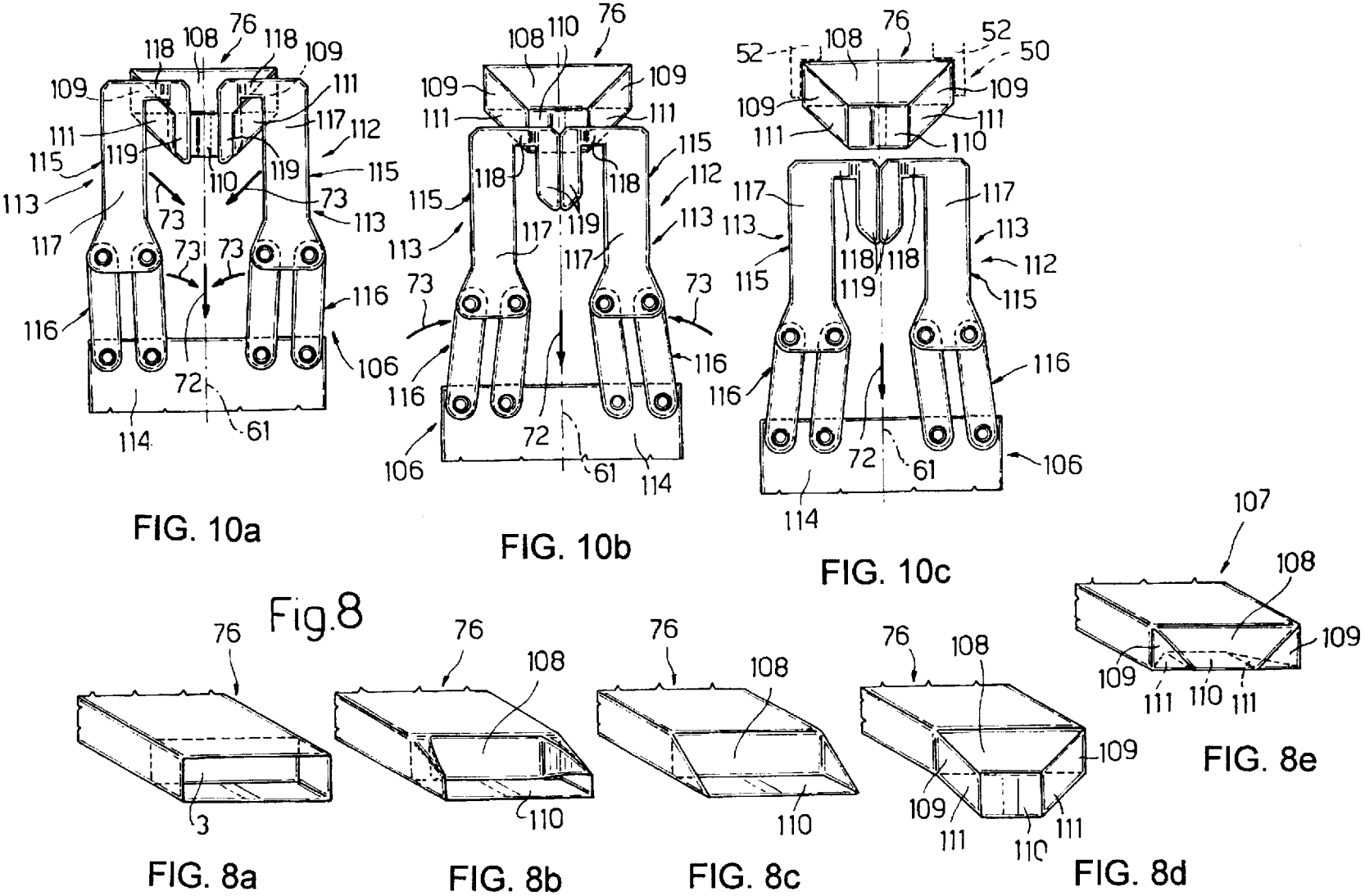
FIGS. 8(A) to 8(E) show views in perspective of successive stages in the folding of a fourth type of wrapping.
FIG. 9A to 9E and 10A to 10C show schematic views of a third variation of a FIG. 2 detail at successive operating stages in the formation of the FIG. 8(*a*) to FIG. 8(*e*) FIG. 8 wrapping.
Figures 9A, 9B, 9C, 9D, 9E:
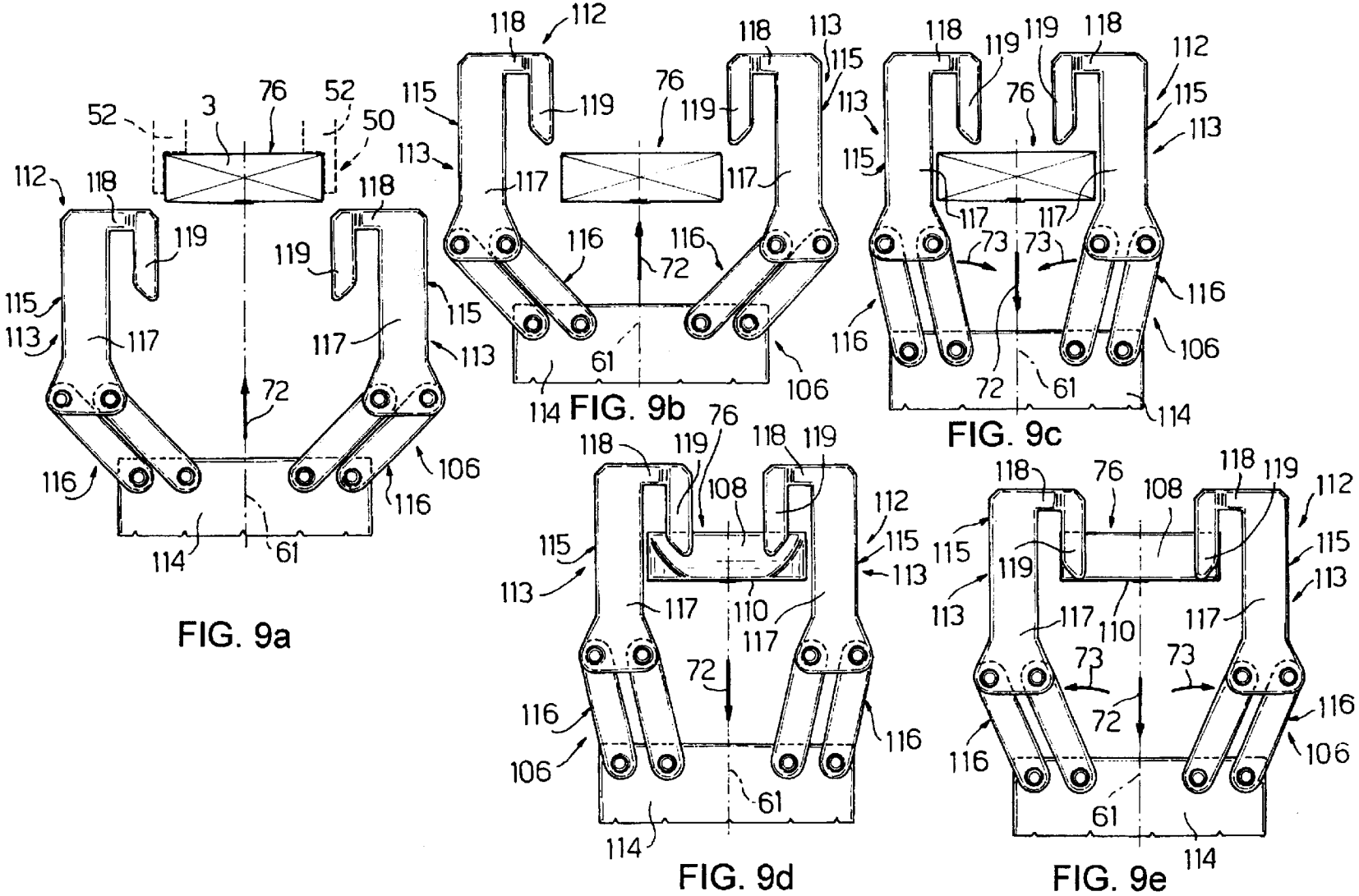

As shown in FIG. 10, head 112 continues moving in direction 72 (FIG. 10A) so that arms 119 engage and fold tab 110 outwards and then abandon wrapping 76; and, at the same time (FIGS. 10A, 10B, 10C), jaws 113 are gradually moved into the closed position in which arms 119 contact each other, so that arms 117 fold tabs 109 on to tab 108 and form tabs 111 of tab 110. Wrapping 107 is then completed by folding tab 110 on to a large outer surface of wrapping 107 by means of a known fixed helical folding device (not shown).

I claim:

1. In a method of continuously wrapping products in wrapping sheets, the improvements comprising:

continuously feeding a succession of products together with respective wrapping sheets at least partially folded about said products along a first path including an intermediate portion having a tangent extending in a first direction;

continuously moving at least one folding tool along a second, closed path into an engagement position wherein said folding tool successively engages said wrapping sheets about said products along said intermediate portion of said first path, and performing at least part of one folding operation on each of said successively engaged wrapping sheets by moving said folding tool into said engagement position in a second direction crosswise to said first direction and by imparting to at least part of said folding tool a component of motion in said first direction.

2. The method as claimed in claim 1, wherein said the second path (P4) comprises at least one portion (1P; OP) inclined in relation to a corresponding portion of said intermediate portion of said first path (P3); said movement in tool (58; 75; 91; 106) travels along said one portion (IP; OP).

3. The method as claimed in claim 1, wherein said products (3) and folding tool (58; 75; 91; 106) move in time with each other along said intermediate portion of said first path in said folding operation.

4. The method as claimed in claim 1, wherein said first (73) and second (72) directions define a plane; said first (P3) and second (P4) paths being coplanar with each other and with said plane.

5. The method as claimed in claim 1, wherein said folding tool (58; 75; 91; 106) is rotated in said engagement position in relation to said second path (P4) to maintain a constant orientation in relation to said engaged product (3).

6. The method as claimed in claim 5, wherein:

said products (3) and folding tool (58; 75; 91; 106) are respectively fed and moved along said paths (P3, P4) by first (48) and second (56) conveyors in said plane; (48) and second (56) conveyors in said plane;

said first conveyor (48) comprises, for each of said products (3), a gripping element (50) in a first position (53) in relation to said first conveyor (48);

said folding tool (58; 75; 91; 106) is in a second position (53) in relation to the second conveyor (56); and said positions (53, 61) are coincident with each other along said intermediate portion of said first path (P3).

7. The method as claimed in claim 1, wherein said folding tool (58; 75; 91; 106) comprises at least one folding element (60; 85; 86; 100; 101; 113) for said movement in said first (73) and second (72) directions in said folding operation.

8. The method as claimed in claim 7, wherein said folding tool (59; 75; 91; 105) comprises a second, opposed folding element (60; 85; 86; 100; 101; 113), the folding elements relatively moving to and from each other for said movement in said first direction (73), said folding elements (60; 65; 86; 100; 101; 113) defining a gripper head (59; 83; 84; 98, 99; 112) for said movement in said second direction (72), whereby to at least partly fold one of said wrapping sheets (5) about a respective one of said products (3).

9. The method as claimed in claim 1, wherein said folding tool (75; 91) comprises a folding element (82; 97) which is moved with said folding tool (75; 91) reciprocatingly in said second direction (12) to at least partly fold said wrapping sheets (5) about said products (3).

* * * * *

UNITED STATES PATENT AND TRADEMARK OFFICE

CERTIFICATE OF CORRECTION

PATENT NO. : 5,809,747

DATED : September 22,1998

INVENTOR(S) : Mario SPATAFORA

It is certified that error appears in the above-identified patent and that said Letters Patent is hereby corrected as shown below:

On Title Page, item 73, "Construzioni" should be -- Costruzioni --.

Signed and Sealed this

Twentieth Day of July, 1999

*Attest:*

Q. TODD DICKINSON

*Attesting Officer*

*Acting Commissioner of Patents and Trademarks*